US012252945B2

(12) United States Patent
Otaif et al.

(10) Patent No.: US 12,252,945 B2
(45) Date of Patent: Mar. 18, 2025

(54) SYSTEM AND METHOD FOR PRESSURE ACTIVATION OF A TOOL IN A WELLBORE

(71) Applicant: SAUDI ARABIAN OIL COMPANY, Dhahran (SA)

(72) Inventors: Hassan W. Otaif, Dhahran (SA); Alexander Boers, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/324,410

(22) Filed: May 26, 2023

(65) Prior Publication Data

US 2024/0392641 A1 Nov. 28, 2024

(51) Int. Cl.
*E21B 34/14* (2006.01)
*E21B 23/04* (2006.01)
*E21B 43/14* (2006.01)

(52) U.S. Cl.
CPC ..... *E21B 23/0413* (2020.05); *E21B 34/142* (2020.05); *E21B 43/14* (2013.01)

(58) Field of Classification Search
CPC ..... E21B 34/142; E21B 23/0413; E21B 43/14
See application file for complete search history.

(56) References Cited

U.S. PATENT DOCUMENTS 6,458,008 B1 10/2002 Hyneman
8,137,152 B2 3/2012 Tsai
8,910,734 B2 12/2014 Salter et al.
9,562,419 B2 2/2017 Fleckenstein et al.
10,281,915 B2 5/2019 Berberian et al.
2012/0085548 A1* 4/2012 Fleckenstein ..... E21B 34/14 166/194
2014/0151054 A1* 6/2014 Norrid ..... E21B 34/14 166/318
2015/0245593 A1 9/2015 O'Mara et al.
2017/0314372 A1* 11/2017 Tolman ..... E21B 43/119
2019/0153799 A1* 5/2019 Hardesty ..... E21B 43/26

FOREIGN PATENT DOCUMENTS

CN 112937710 A * 6/2021 ..... B60L 50/60

OTHER PUBLICATIONS

Buzi, E. et al.; "Sensor Ball: An Autonomous Logging Robot for Oil Wells", AIChE The Global Home of Chemical Engineers, Apr. 20, 2021 (4 pages).

* cited by examiner

*Primary Examiner* — Giovanna Wright
*Assistant Examiner* — Ronald R Runyan
(74) *Attorney, Agent, or Firm* — Osha Bergman Watanabe & Burton LLP

(57) ABSTRACT

A system and a method for pressure activation of a tool in a wellbore is disclosed. The system comprises one or more sealing seat for being set in the tool in a horizontal section of the wellbore. The system further comprises and one or more self-driven sealing ball for being activated to roll through the wellbore independently from fluid speed and motion and come to be in place in the sealing seat. The method comprises steps: setting at least one sealing seat in the tool in a horizontal section of the wellbore, activating a self-driven sealing ball to roll through the wellbore independently from fluid speed and motion and come to be in place in the sealing seat, and pressurizing the wellbore to function the tool.

20 Claims, 8 Drawing Sheets

SYSTEM AND METHOD FOR PRESSURE ACTIVATION OF A TOOL IN A WELLBORE

BACKGROUND

In the oil and gas industry, sets of sealing balls and sealing seats are used to set and function tools like liner hangers and packers in a wellbore. Usually, a sealing ball is pumped downhole. When the sealing ball lands on its sealing seat, a string of the tools can be pressurized, and the tool be activated.

The sealing ball that is dropped downhole for activating the tool travels through several thousand feet of a horizontal section in the wellbore before reaching the seat. Challenges to overcome may be a low flow rate, a low ball velocity, fluid bypass, angle inversions, etc. For instance, a flow rate may be very low due to open hole resistance and, thus, the ball will roll at a very low velocity, which causes fluid bypass and stalls progress. Further, there may be angle inversions in the well profile so that the ball has to roll slightly uphill. Also, the ball seat is usually located in the center of the pipe so that higher fluid velocities are necessary to move the ball upward to the sealing seat.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments relate to a system for pressure activation of a tool in a wellbore. The system comprises one or more sealing seat for being set in the tool in a horizontal section of the wellbore. The system further comprises and one or more self-driven sealing ball for being activated to roll through the wellbore independently from fluid speed and motion and come to be in place in the sealing seat.

In another aspect, embodiments relate to a completion tool. The tool comprises a string for being set in a horizontal section of a wellbore, one or more sealing seat for being set in the string, and a self-driven sealing ball for being activated to roll through the string in the horizontal section of the wellbore independently from fluid speed and motion and come to be in place in the sealing seat.

In a further aspect, embodiments relate to a method for pressure activation of a tool in a wellbore. The method comprises steps: setting at least one sealing seat in the tool in a horizontal section of the wellbore, activating a self-driven sealing ball to roll through the wellbore independently from fluid speed and motion and come to be in place in the sealing seat, and pressurizing the wellbore to function the tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of example, a first element is distinct from a second element, and the first element may encompass more than one element and succeed (or precede) the second element in an ordering of elements.

In the following description of FIGS. 1-8, any component described regarding a figure, in various embodiments disclosed herein, may be equivalent to one or more like-named components described with regard to any other figure. For brevity, descriptions of these components may not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a sealing seat" includes reference to one or more such sealing seat.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 1:
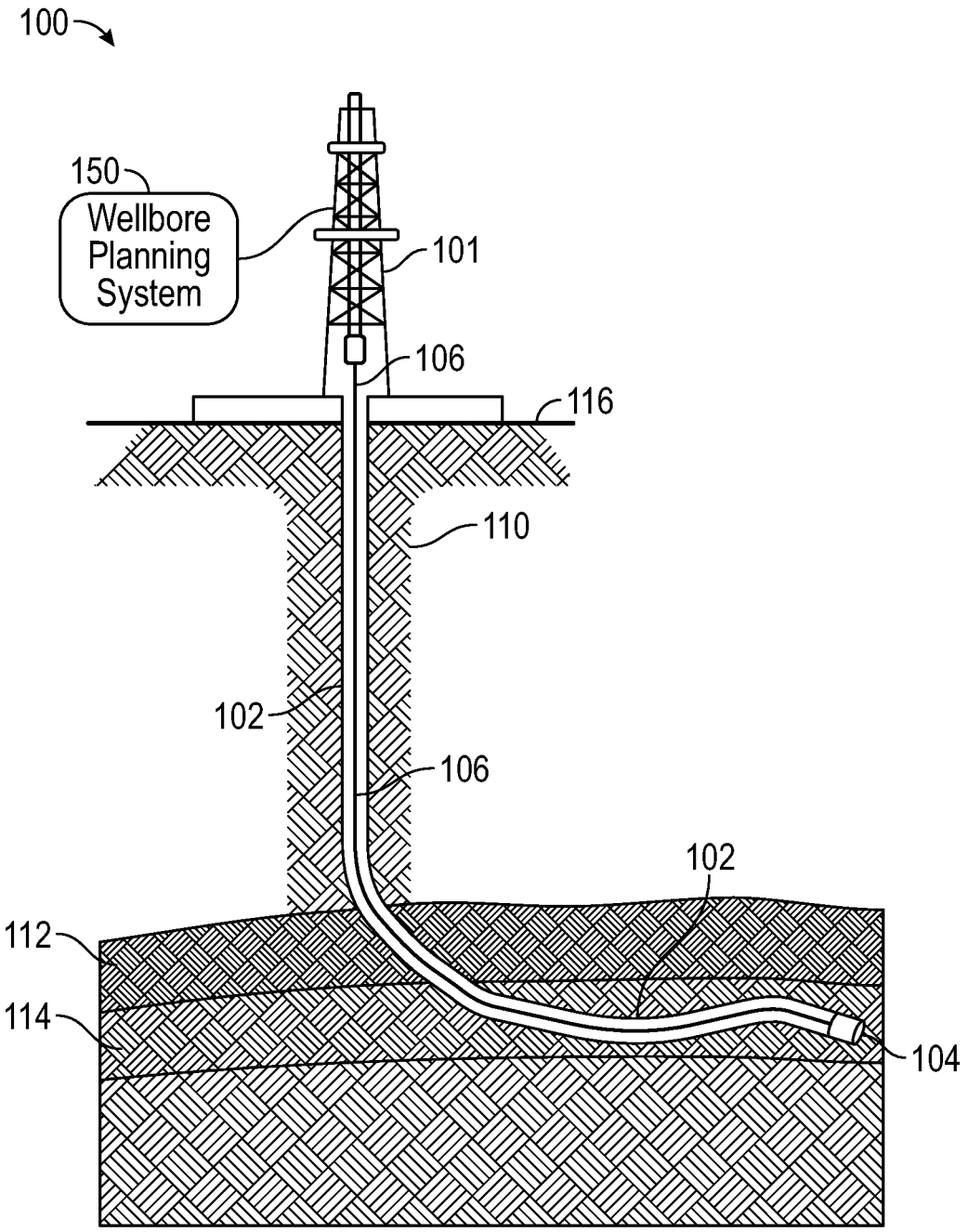
FIG. 1 shows a wellbore drilling system in accordance with one or more embodiments.

FIG. 1 shows a wellbore drilling system 100 in accordance with one or more embodiments. As shown in FIG. 1, a wellbore path 102 may be drilled by a drill bit 104 attached by a drillstring 106 to a drill rig 101 located on the surface 116 of the earth. The wellbore may traverse a plurality of overburden layers 110 and one or more cap-rock layers 112 to a hydrocarbon reservoir 114. In accordance with one or more embodiments, a seismic image may be used to plan a wellbore path 102 and drill a wellbore guided by the wellbore path 102. The wellbore path 102 may be a curved wellbore path, or a straight wellbore path. All or part of the wellbore path 102 may be vertical, and some wellbore paths may be horizontal or deviated.

Prior to the commencement of drilling, a wellbore plan may be generated. The wellbore plan may include a starting surface location of the wellbore, or a subsurface location within an existing wellbore, from which the wellbore may be drilled. Further, the wellbore plan may include a terminal location that may intersect with the targeted hydrocarbon bearing formation and a planned wellbore path 102 from the starting location to the terminal location. In other words, the wellbore path 102 may intersect a previously located hydrocarbon reservoir 114.

Typically, the wellbore plan is generated based on best available information from a geophysical model, geomechanical models encapsulating subterranean stress conditions, the trajectory of any existing wellbores (which it may be desirable to avoid, and the existence of other drilling hazards, such as shallow gas pockets, over-pressure zones, and active fault planes. Furthermore, the wellbore plan may consider other engineering constraints such as the maximum wellbore curvature that the drillstring 106 may tolerate and the maximum torque and drag values that the wellbore drilling system 100 may tolerate.

A wellbore planning system 150 may be used to generate the wellbore plan. The wellbore planning system 150 may comprise one or more computer processors in communication with computer memory containing the geophysical and geomechanical models, information relating to drilling hazards, and the constraints imposed by the limitations of the drillstring 106 and the wellbore drilling system 100. The wellbore planning system 150 may further include dedicated software to determine the planned wellbore path 102 and associated drilling parameters, such as the planned wellbore diameter, the location of planned changes of the wellbore diameter, the planned depths at which casing will be inserted to support the wellbore and to prevent formation fluids entering the wellbore, and the drilling mud weights (densities) and types that may be used during drilling the wellbore.

A wellbore may be drilled using a drill rig 101 that may be situated on a land drill site, an offshore platform, such as a jack-up rig, a semi-submersible, or a drill ship. The drill rig 101 may be equipped with a hoisting system, which can raise or lower the drillstring 106 and other tools required to drill the well. The drillstring 106 may include one or more drill pipes connected to form conduit and a bottom hole assembly (BHA) disposed at the distal end of the drillstring 106. The BHA may include a drill bit 104 to cut into subsurface rock. The BHA may further include measurement tools, such as a measurement-while-drilling (MWD) tool and logging-while-drilling (LWD) tool. MWD tools may include sensors and hardware to measure downhole drilling parameters, such as the azimuth and inclination of the drill bit, the weight-on-bit, and the torque. The LWD measurements may include sensors, such as resistivity, gamma ray, and neutron density sensors, to characterize the rock formation surrounding the wellbore. Both MWD and LWD measurements may be transmitted to the surface 116 using any suitable telemetry system, such as mud-pulse or wired-drill pipe, known in the art.

To start drilling, or "spudding in" the well, the hoisting system lowers the drillstring 106 suspended from the drill rig 101 towards the planned surface location of the wellbore. An engine, such as a diesel engine, may be used to rotate the drillstring 106. The weight of the drillstring 106 combined with the rotational motion enables the drill bit to bore the wellbore.

The near-surface is typically made up of loose or soft sediment or rock, so large diameter casing, e.g. "base pipe" or "conductor casing," is often put in place while drilling to stabilize and isolate the wellbore. At the top of the base pipe is the wellhead, which serves to provide pressure control through a series of spools, valves, or adapters. Once near-surface drilling has begun, water or drill fluid may be used to force the base pipe into place using a pumping system until the wellhead is situated just above the surface 116 of the earth.

Drilling may continue without any casing once deeper more compact rock is reached. While drilling, drilling mud may be injected from the surface 116 through the drill pipe. Drilling mud serves various purposes, including pressure equalization, removal of rock cuttings, or drill bit cooling and lubrication. At planned depth intervals, drilling may be paused and the drillstring 106 withdrawn from the wellbore. Sections of casing may be connected and inserted and cemented into the wellbore. Casing string may be cemented in place by pumping cement and mud, separated by a "cementing plug," from the surface 116 through the drill pipe. The cementing plug and drilling mud force the cement through the drill pipe and into the annular space between the casing and the wellbore wall. Once the cement cures drilling may recommence. The drilling process is often performed in several stages. Therefore, the drilling and casing cycle may be repeated more than once, depending on the depth of the wellbore and the pressure on the wellbore walls from surrounding rock. Due to the high pressures experienced by deep wellbores, a blowout preventer (BOP) may be installed at the wellhead to protect the rig and environment from unplanned oil or gas releases. As the wellbore becomes deeper, both successively smaller drill bits and casing string may be used. Drilling deviated or horizontal wellbores may require specialized drill bits or drill assemblies.

A wellbore drilling system 100 may be disposed at and communicate with other systems in the well environment. The wellbore drilling system 100 may control at least a portion of a drilling operation by providing controls to various components of the drilling operation. In one or more embodiments, the system may receive data from one or more sensors arranged to measure controllable parameters of the drilling operation. As a non-limiting example, sensors may be arranged to measure WOB (weight on bit), RPM (drill rotational speed), GPM (flow rate of the mud pumps), and ROP (rate of penetration of the drilling operation). Each sensor may be positioned or configured to measure a desired physical stimulus. Drilling may be considered complete when a target zone is reached, or the presence of hydrocarbons is established.

After drilling a wellbore path, the phase of well completion may start to prepare for a wellbore ready to produce oil or gas. Further, a wellbore may require maintenance or intervention over time to repair damaged and underperforming wells. In completion, intervention, or production, it often necessary to set and operate tools, such as liner hangers, packers, etc.

FIGS. 2A-2D illustrate a system for pressure activation of a tool 200 according to one or more embodiments. The tool 200 may be, for example, used in wellbore completion, intervention, production, and others, and may comprise a string 201 which is set in a horizontal section of a wellbore 102.

The system comprises a sealing seat 300, which is set in the string 201 to divide the string into multiple zones. The sealing seat 300 comprises a through hole 301 which allows fluid to flow through the sealing seat 300. The through hole 301 includes two end notches on both sides 305/306 of the sealing seat 300 along the string 201.

The system further comprises a self-driven sealing ball 400 which may be activated to roll through the wellbore independently from fluid speed and motion in the string 201 and come to be in place in an end notch of the through hole 301 in the sealing seat 300. The sealing ball 400 has a size which matches the end notch of the through hole 301 in the sealing seat 300. As such, the string 201 can be sealed when the sealing ball 400 comes to be in place in one of the end notches of the through hole 301 of the sealing seat 300.

Figure 2A:
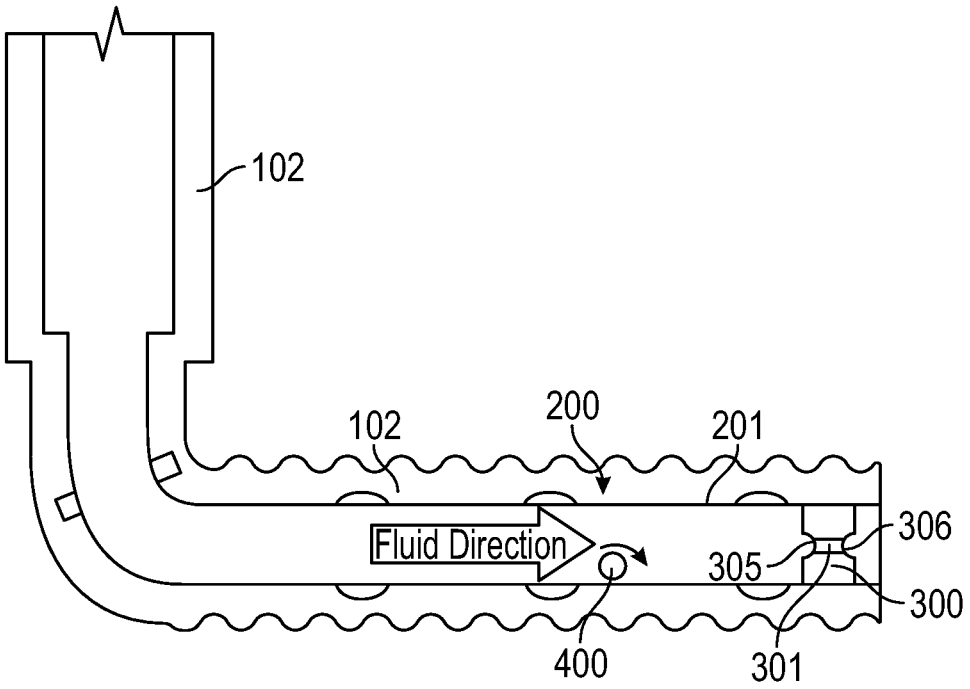
FIGS. 2A-2D illustrate a system for pressure activation of a tool in accordance with one or more embodiments.
Figure 2B:
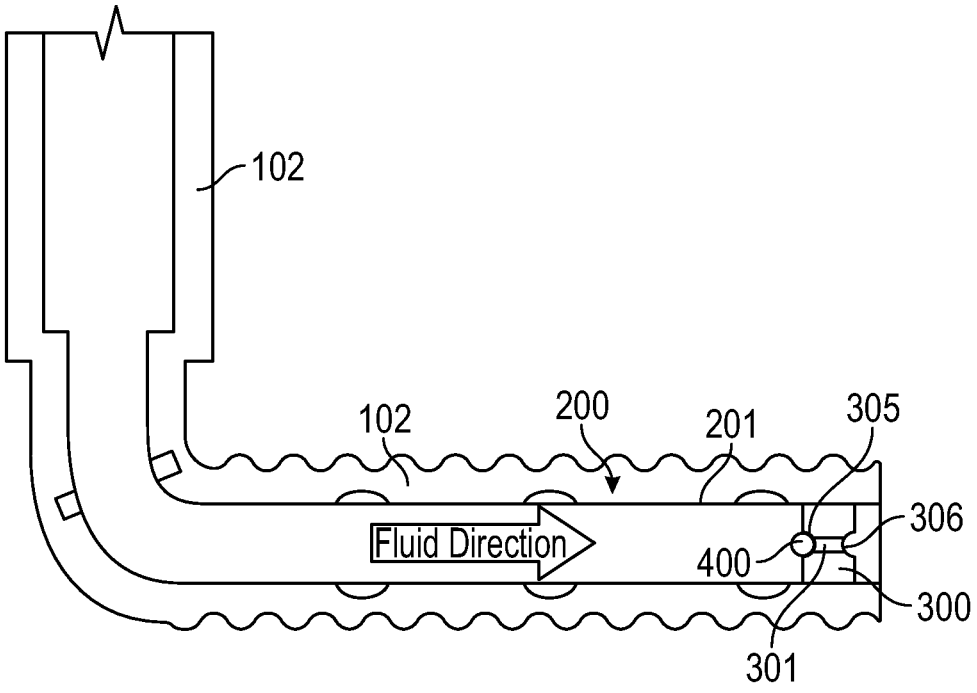

As shown in FIGS. 2A and 2B, when the fluid direction runs through the sealing seat 300 from the left side 305 to the right side 306 seen in the figures, a sealing ball 400 is activated to roll toward the left side 305 of the sealing seat 300. When the sealing ball 400 comes into place in the notch on the left side 305 of the through hole 301, pressure from the fluid in the string 201 will keep the sealing ball 400 in the notch and prevent the fluid from flowing through the through hole 301 of the sealing seat 300. As such, the zone from the right side of the sealing seat 300 in the string 201 is deactivated. If necessary, the sealing ball 400 may be activated to roll out of place from the notch of the sealing seat 300 to reactivate the zone from the right side of the sealing seat 300 in the string 201.

Figure 2C:
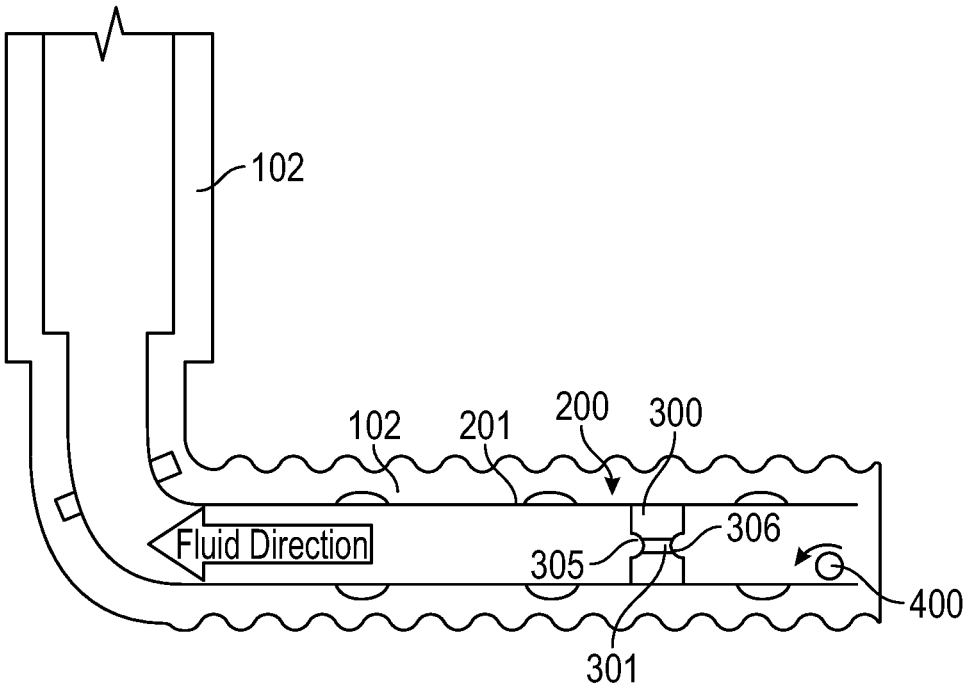
Figure 2D:
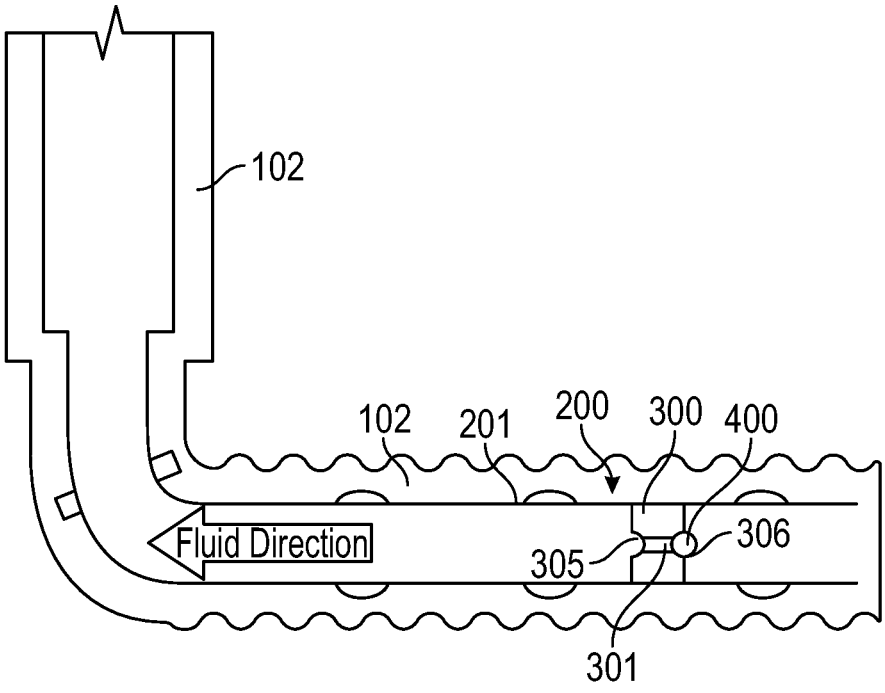

Alternatively, as shown in FIGS. 2C and 2D, when the fluid direction runs through the sealing seat 300 from the right side 306 to the left side 305, a sealing ball 400 is activated to roll toward the right side 306 of the sealing seat 300. When a sealing ball 400 comes to be in place in the notch of the through hole 301 on the right side 306, a pressure from the fluid in the string 201 will keep the sealing ball 400 on the notch of the right side 306 and prevent the fluid from flowing through the through hole 301 of the sealing seat 300. As such, the zone from the right side of the sealing seat in the string is deactivated. If necessary, the sealing ball 400 may be activated to roll out of place from the seat 300 to reactivate the zone.

Figure 3A:
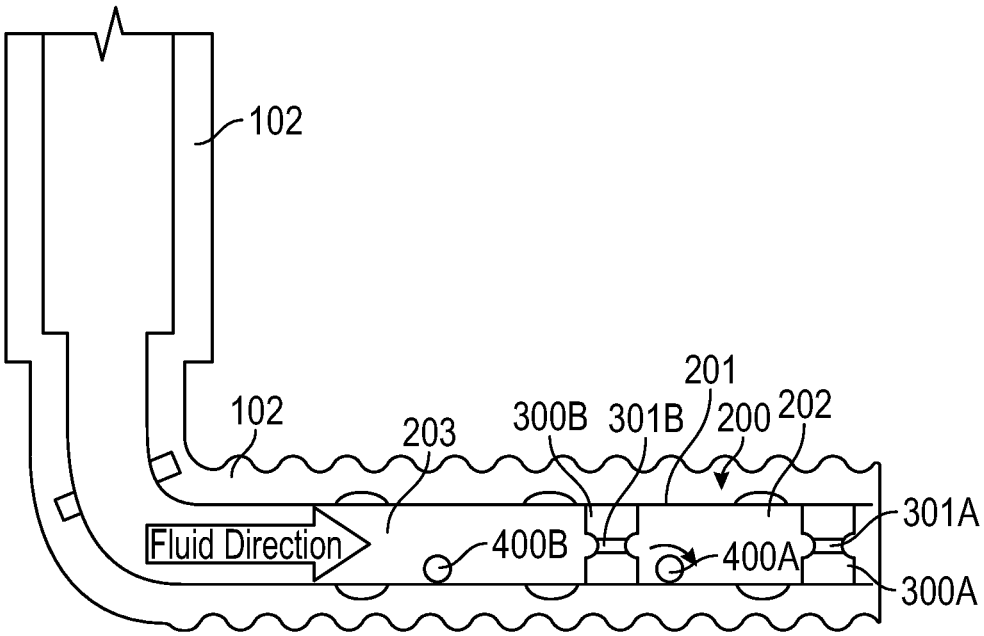
FIGS. 3A and 3B illustrate another form of the system for pressure activation of a tool in accordance with one or more embodiments.
Figure 3B:
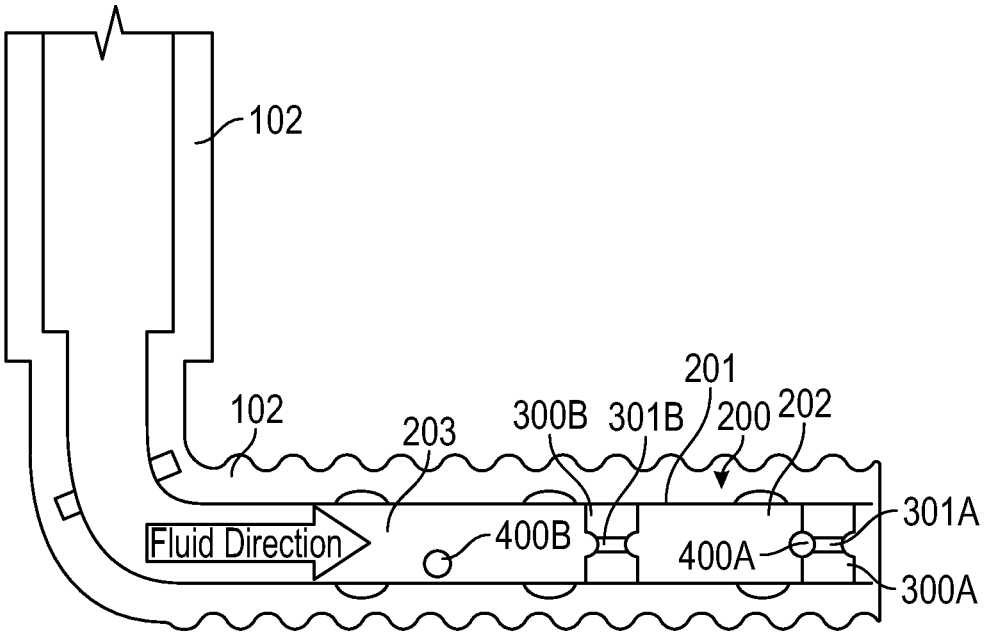

FIGS. 3A and 3B illustrate another form of the system for pressure activation of a tool 200 according to one or more embodiments. The tool 200 may be, for example, used in a wellbore completion, intervention, or production, or others, and comprise a string 201 which is set in a horizontal section of a wellbore 102.

The system comprises two or more sealing seats. For example, as shown, there are a first sealing seat 300A and a second sealing seat 300B separately for being set at two different locations along the horizontal section of the string 201. As such, the string 201 is divided to include multiple zones, like a first zone 202 and a second zone 203. The first sealing seat 300A comprises a first through hole 301A, and the second sealing seat 300B comprises a second through hole 301B. Each of the through holes allows fluid flow through the sealing seat and includes two end notches on both sides of a sealing seat.

The system further comprises two or more self-driven sealing balls. For example, as shown, there are a first sealing ball 400A and a second sealing ball 400B for being selectively activated to roll and come to be in place in the first seat 300A and the second seat 300B. The first sealing ball 400A and the second sealing ball 400B have sizes which separately match the end notches of the corresponding through holes in the corresponding sealing seats. As such, the zone 202 and the zone 203 may be separately sealed by selectively activating the sealing balls 400A and 400B to come to be in place in the corresponding end notch of the though holes of the seats 300A and 300B.

As shown in FIGS. 3A and 3B, when the fluid direction runs through the seat 300A from the left side to the right side, a sealing ball 400A is activated to roll toward the left side of the seat 300A. When the sealing ball 400A comes to be in place in the left end notch of the through hole 301A, a pressure from the fluid in the string 201 will keep the sealing ball 400A on the left end notch of the through hole 301A and prevent the fluid from flowing through the seat 300A. As such, the zone of the string 201 on the right side of the seat 300A is deactivated. If necessary, the sealing ball 400A may be activated to roll out of place from the seat 300A to reactivate the zone.

Though not shown, it is appreciated that, if the fluid runs through the sealing seat 300A from the right side to the left side, the sealing ball 400A may be activated to roll toward the right side of the sealing seat 300B. When a sealing ball 400A comes to be in place in the right end notch of the through hole 301B, a pressure from the fluid in the string 201 will keep the sealing ball 400A on the right end notch of the through hole 301B and prevent the fluid from flowing through the sealing seat 300B. As such, the zone 202 is deactivated. If necessary, the sealing ball 400A may be activated to roll out of place from the seat 300B to activate the zone 202.

Likewise, though not shown, it is appreciated that, when the fluid runs through the seat 300B from the left side to the right side, a sealing ball 400B may be activated to roll toward the left side of the sealing seat 300B. When the sealing ball 400B comes to be in place in the left end notch of the through hole 301B, a pressure from the fluid in the zone 203 of the string 201 will keep the sealing ball on the left end notch of the through hole 301B and prevent the fluid from flowing through the sealing seat 300B. As such, the zone 202 of the string 201 on the right side of the sealing seat 300B is deactivated. If necessary, the sealing ball 400B may be activated to roll out of place from the seat 300B to reactivate the zone 202.

Figure 4:
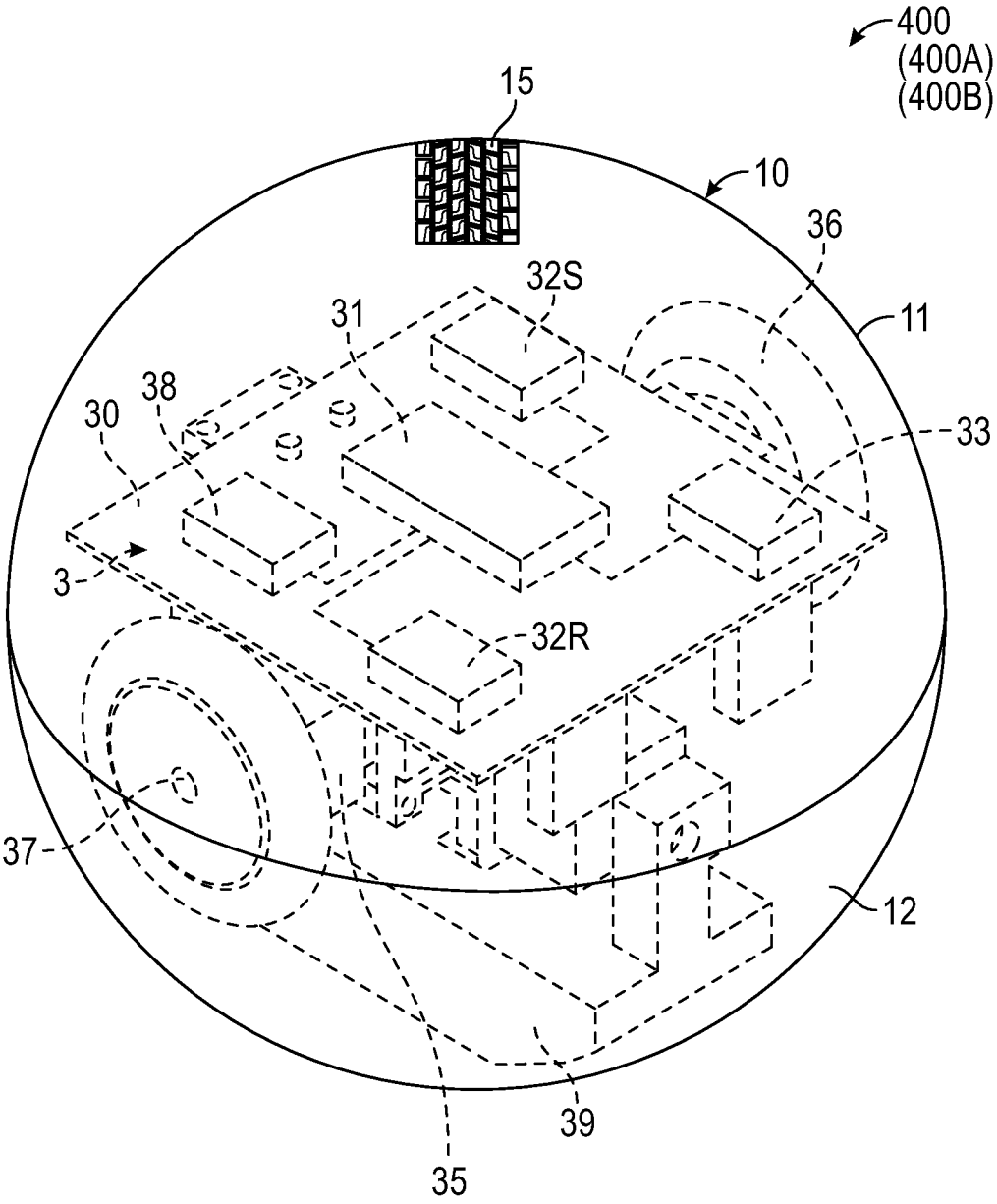
FIGS. 4-6 illustrate a seal-driven sealing ball in accordance with one or more embodiments.
Figure 5:
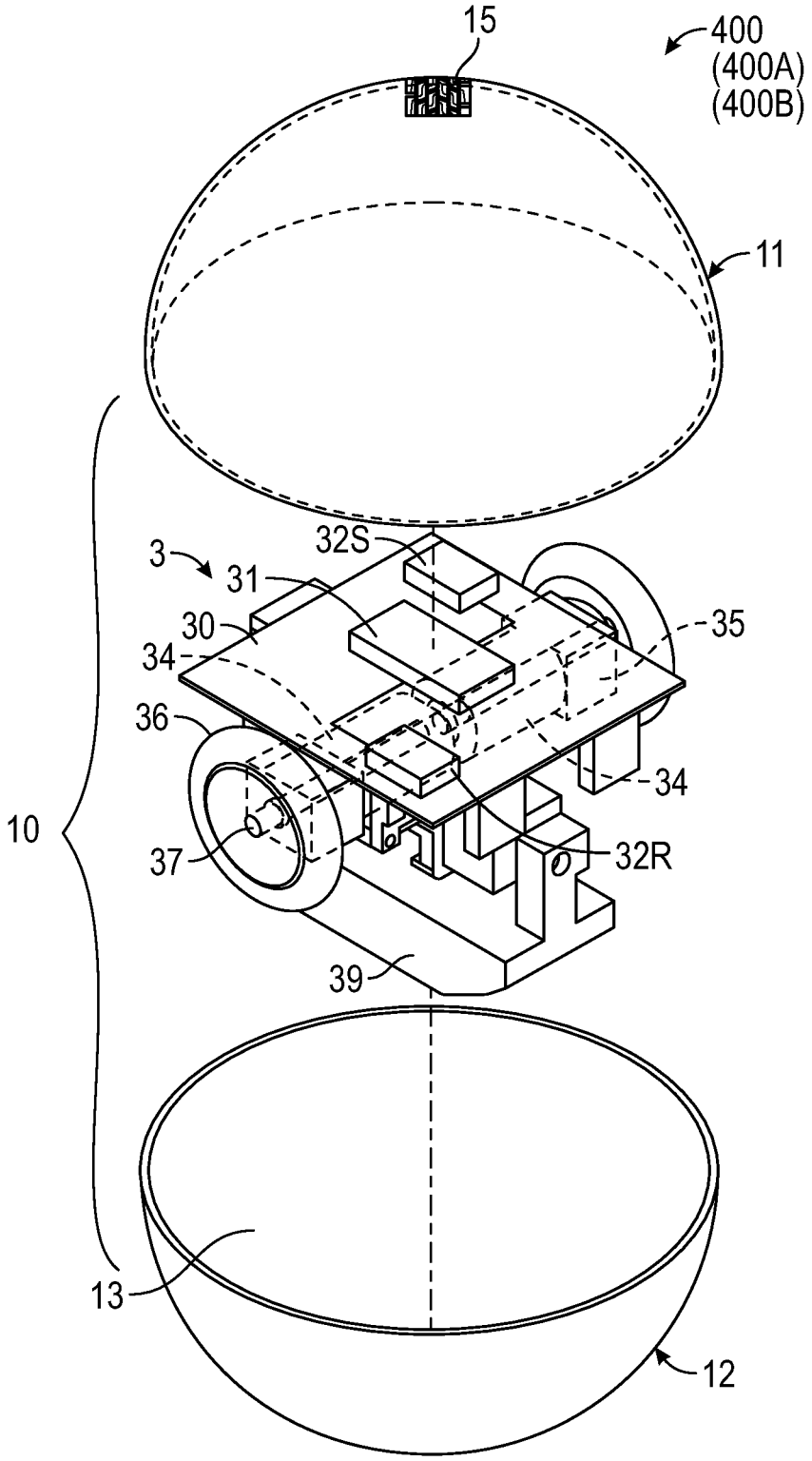
Figure 6:
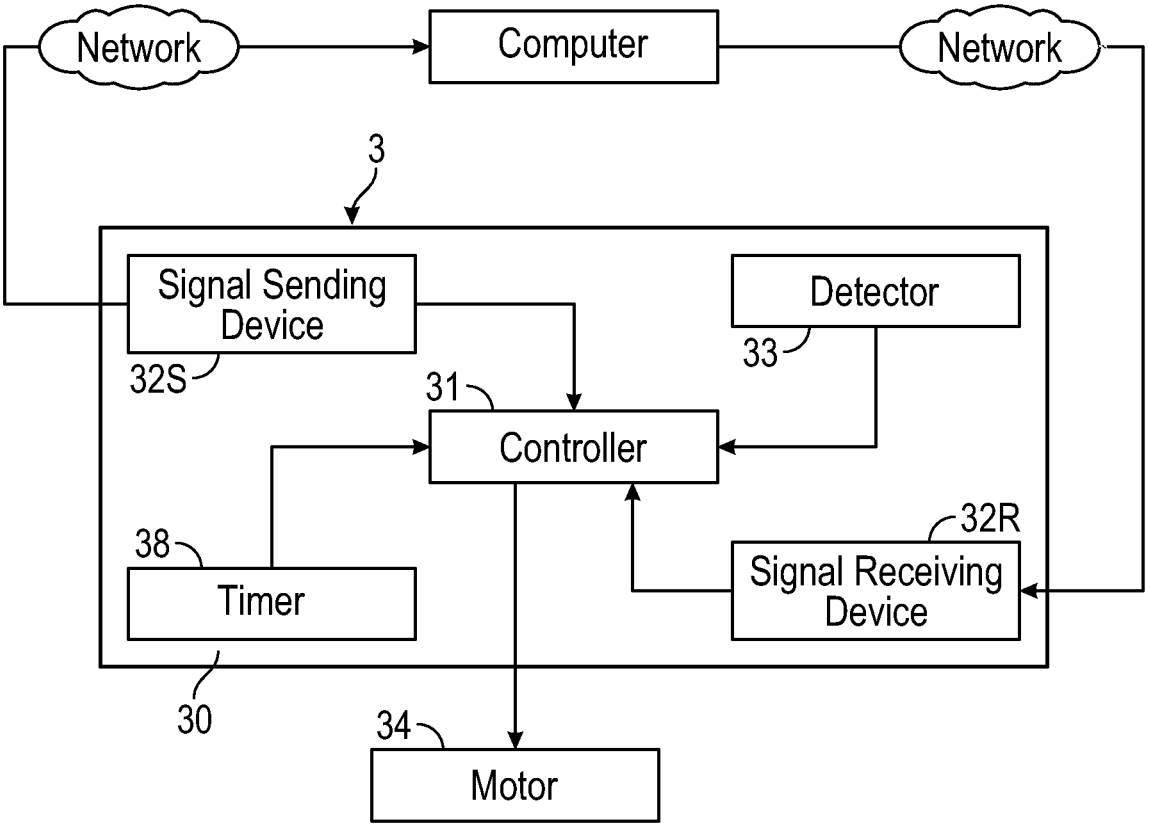

The self-driven sealing ball may be chosen to be made in many forms. A particular form of seal-driven sealing ball is illustrated in FIGS. 4-6 for the sealing ball 400 or the sealing ball 400A or the sealing ball 400B in accordance with one or more embodiments. Some elements of the sealing ball are removed from some figures to better show other elements. For instance, a detector 33 and a timer 38 are shown in FIG. 4, but are removed in FIG. 5 to better show a battery 35 underneath. The sealing ball comprises two or more housing members 11, 12 mounted or secured together to form a spherical or polygonal shell 10. The shell 10 defines a chamber 13 sealing from outside fluid for receiving an actuator 3 therein.

The actuator 3 includes a plate or circuit board 30 disposed in the chamber 13. A controller 31 is attached or mounted or secured to the circuit board 30. One or more (such as two) motors 34 powered by a battery 35 are further provided and attached or mounted or secured to the circuit board 30, such as attached or mounted to the bottom portion of the circuit board 30 and electrically coupled or connected to the controller 31. The motors 34 each include a roller or wheel 36 attached or mounted or secured to a spindle 37 thereof, for driving or rotating the wheels 36 relative to the motors 34 and the shell 10. The wheels 36 are contacted or engaged with the shell 10 for allowing the shell 10 to be moved or actuated or operated by the wheels 36 and to be moved on land and on water.

The actuator 3 may further comprise one or more detector 33 for sensing the orientation of the shell 10. The detector 33 is selected from a G-sensor, an acceleration sensor, or an inclination angle detector or camera, etc. The detector may be attached or mounted or secured to the circuit board 30 and electrically coupled or connected to the controller 31. In operation, the detector may be used to sense or detect the inclination angle or status of the circuit board 30 or the environment in the wellbore, and may then send or transmit the detected signals to the controller 31 which may then process the detected signals for controlling the motors 34 to move or rotate or drive the wheels 36 in the same speed, or in different rotational speed for moving or driving or rotating or maneuvering the shell 10 on land and on water.

The actuator 3 may further comprise a timer 38 for sending a signal to the controller 31 to activate the sealing ball to roll through the wellbore and engage the sealing seat when a scheduled deployment is not achieved. In one or more embodiments, the timer 38 may start counting, for example, once a sealing ball is dropped into the wellbore or other designated event occurs. The sealing ball will not be activated to self-drive within a predefined time period, e.g., 60 minutes. In the event the sealing ball reaches its seat before the predefined time period, the timer 38 may be controlled by the controller 31 to end counting. Otherwise, if the sealing ball still does not to reach its sealing seat after the predefined time period, i.e., scheduled deployment is not achieved, the timer 38 sends a signal to the controller 31 to activate the sealing ball to roll through the wellbore independently from fluid speed and motion and engage the sealing seat. A successful deployment of the sealing ball in the sealing seat may be detected, for example, by a pressure transducer when a pressure spike occurs. The pressure transducer may be deployed with the sealing ball, the sealing seat or other suitable position within the string.

A controller is known in the art. For example, the controller 31 may comprise one or more processors and a computer-readable medium storing program instructions that, when executed by the one or more processors, cause the one or more processors to send out controlling signals for the motor 34. For example, when the detector 33 senses or detects that the circuit board 30 are tilted or inclined forwardly relative to the ground or the like, it may then supply or send or transmit the detected inclination angle or status or signals of the circuit board 30 to the controller 31, which may then process and send or transmit a controlling signal to the motor 34 to move or rotate or drive the wheels 36 and thus to move or drive or maneuver the shell 10 forwardly. For example, the controlling signal may be a pivoting or rotating signal, and the motors 34 may then be actuated or operated by the controller 31 at the same speed, or at different rotational speeds to actuate the wheels 36 and to move or drive or maneuver or pivot or rotate the shell 10 on land and on water.

The actuator 3 may further comprise a signal sending device 32S and a signal receiving device 32R which may be attached or mounted or secured to the circuit board 30 and electrically coupled or connected to the controller 31. The signal receiving device 32R and the signal sending device 32S may be configured to communicate with a computer on surface via a network. The computer may receive and process the signals from the signal sending device 32S and send control signals to the controller 31 via the signal receiving device 32R for control of the motor 34 and in turn the sealing ball to roll through the wellbore. As such, the sealing ball can be actuated remotely on the surface of earth.

For example, when the detector 33 senses or detect that the circuit board 30 are tilted or inclined forwardly relative to the ground or the like, it may then supply or send or transmit the detected inclination angle or status or signals of the circuit board 30 to the controller 31, and the signal sending devices 32S may then supply or send or emit the angle signals to the surface computer, which may then process and send or transmit a controlling signal to the signal receiving devices 32R for the controller 31 to move or rotate or drive the wheels 36 and thus to move or drive or maneuver the shell 10 forwardly. A pivoting or rotating signals may be provided by the computer to the signal receiving devices 32R, which may then send or transmit the received signals to the controller 31, and the motors 34 may then be actuated or operated by the controller 31 in the same speed, or in different rotational speed in order to actuate the wheels 36 and to move or drive or maneuver or pivot or rotate the shell 10 on land and on water.

The shell 10 may be made of any appropriate material including plastic, metal, or both. Further, the shell 10 may comprise a traction mechanism 15 on the outer surface. The traction mechanism 15 may be an efficient propelling system, for example tracks, rubber traction pads, mild adhesive rubber etc., applied on part or all of the outer surface of the shell 10 to overcome well angle inversions and a potential slippery oil coating on the internal surface of downhole pipes and strings.

A weight member 39 may further be provided and attached or mounted or secured to the motors 34, or directly attached or mounted to the circuit board 30 for balancing or erecting the shell 10 during the rolling of the ball 400.

Figure 7:
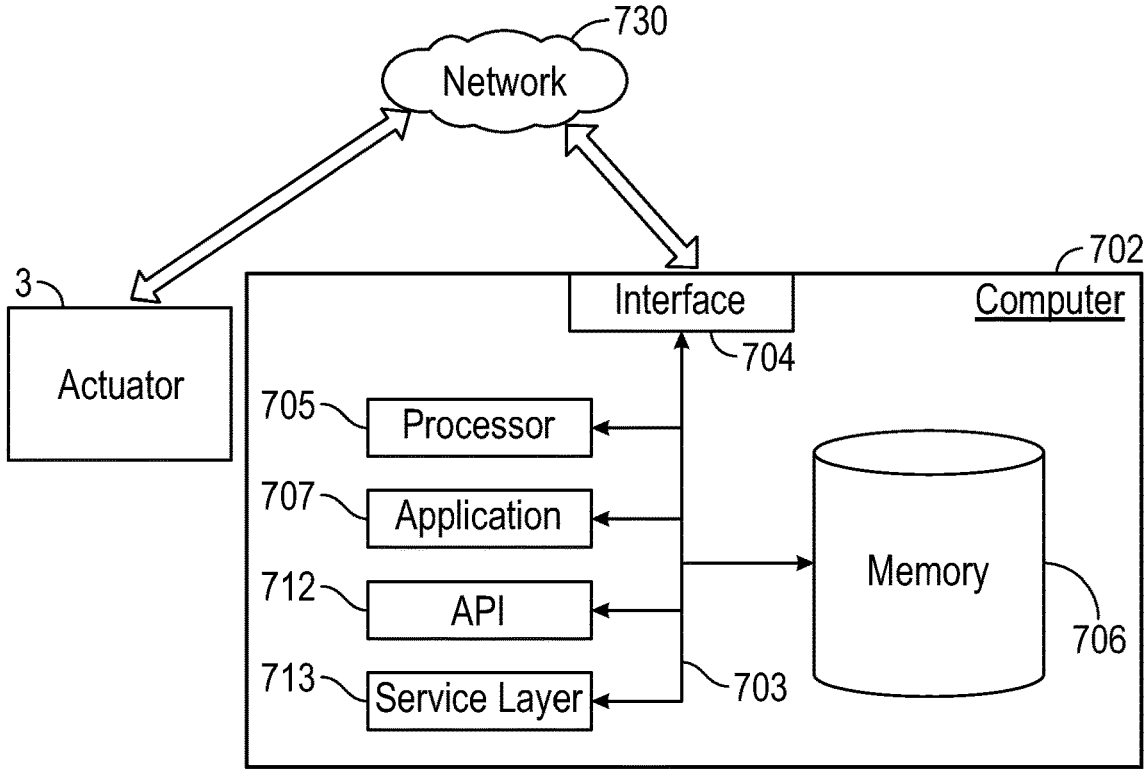
FIG. 7 shows a computer in accordance with one or more embodiments.

FIG. 7 shows a computer 702 in accordance with one or more embodiments. The computer 702 may be used to provide computational functionalities associated with described algorithms, methods, functions, processes, flows, and procedures as described in the present disclosure, according to one or more embodiments. For example, the computer 702 communicates via network 730 with the controller 31 of the sealing ball 400 (400A, 400B) as described above in accordance with one or more embodiments. The illustrated computer 702 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 702 may include a computer that includes an input device, such as a keypad, keyboard, touch screen, or other device that can accept user information, and an output device that conveys information associated with the operation of the computer 702, including digital data, visual, or audio information (or a combination of information), or a graphical user interface (GUI).

The computer 702 can serve in a role as a client, network component, a server, a database or other persistency, or any other component (or a combination of roles) of a computer system for performing the subject matter described in the instant disclosure. The illustrated computer 702 is communicably coupled with a network 730. For example, the computer 702 and a controller 31 of the sealing ball 400 (400A, 400B) as described above in accordance with one or more embodiments may be communicably coupled using a network 730. In some implementations, one or more components of the computer 702 may be configured to operate within environments, including cloud-computing-based, local, global, or other environment (or a combination of environments).

At a high level, the computer 702 is an electronic computing device operable to receive, transmit, process, store, or manage data and information associated with the described subject matter. According to some implementations, the computer 702 may also include or be communicably coupled with an application server, e-mail server, web server, caching server, streaming data server, business intelligence (BI) server, or other server (or a combination of servers).

The computer 702 can receive requests over network 730 from a client application, for example, executing on another computer 702 and responding to the received requests by processing the said requests in an appropriate software application. For example, the computer 702 may receive signals over a network 730 from the signal sending device 32S of the actuator 3 and respond to the received requests appropriately. In addition, requests may also be sent to the computer 702 from internal users (for example, from a command console or by other appropriate access method), external or third-parties, other automated applications, as well as any other appropriate entities, individuals, systems, or computers.

The computer 702 includes an interface 704. Although illustrated as a single interface 704 in FIG. 7, two or more interfaces 704 may be used according to particular needs, desires, or particular implementations of the computer 702. The interface 704 is used by the computer 702 for communicating with other systems in a distributed environment that are connected to the network 730. Generally, the interface 704 includes logic encoded in software or hardware (or a combination of software and hardware) and operable to communicate with the network 730. More specifically, the interface 704 may include software supporting one or more communication protocols associated with communications such that the network 730 or interface's hardware is operable to communicate physical signals within and outside of the illustrated computer 702.

The computer 702 also includes at least one computer processor 705. Although illustrated as a single computer processor 705 in FIG. 7, two or more processors may be used according to particular needs, desires, or particular implementations of the computer 702. Generally, the computer processor 705 executes instructions and manipulates data to perform the operations of the computer 702 and any algorithms, methods, functions, processes, flows, and procedures as described in the instant disclosure.

The computer 702 further includes a memory 706 that holds data for the computer 702 or other components (or a combination of both) that can be connected to the network 730. For example, memory 706 can be a database storing data consistent with this disclosure. Although illustrated as a single memory 706 in FIG. 7, two or more memories may be used according to particular needs, desires, or particular implementations of the computer 702 and the described functionality. While memory 706 is illustrated as an integral component of the computer 702, in alternative implementations, memory 706 can be external to the computer 702.

The application 707 is an algorithmic software engine providing functionality according to particular needs, desires, or particular implementations of the computer 702, particularly with respect to functionality described in this disclosure. For example, application 707 can serve as one or more components, modules, applications, etc. Further, although illustrated as a single application 707, the application 707 may be implemented as multiple applications 707 on the computer 702. In addition, although illustrated as integral to the computer 702, in alternative implementations, the application 707 can be external to the computer 702.

Each of the components of the computer 702 can communicate using a system bus 703. In some implementations, any or all of the components of the computer 702, both hardware or software (or a combination of hardware and software), may interface with each other or the interface 704 (or a combination of both) over the system bus 703 using an application programming interface (API) 712 or a service layer 713 or a combination of the API 712 and service layer 713. The API 712 may include specifications for routines, data structures, and object classes. The API 712 may be either computer-language independent or dependent and refer to a complete interface, a single function, or even a set of APIs.

The service layer 713 provides software services to the computer 702 or other components (whether illustrated or not) that are communicably coupled to the computer 702. The functionality of the computer 702 may be accessible for all service consumers using this service layer. Software services, such as those provided by the service layer 713, provide reusable, defined business functionalities through a defined interface. For example, the interface may be software written in JAVA, C++, or other suitable language providing data in extensible markup language (XML) format or another suitable format. While illustrated as an integrated component of the computer 702, alternative implementations may illustrate the API 712 or the service layer 713 as stand-alone components in relation to other components of the computer 702 or other components (whether or not illustrated) that are communicably coupled to the computer 702. Moreover, any or all parts of the API 712 or the service layer 713 may be implemented as child or sub-modules of another software module, enterprise application, or hardware module without departing from the scope of this disclosure.

There may be any number of computers 702 associated with, or external to, a computer system containing computers 702, wherein each computer 702 communicates over network 730. Further, the term "client," "user," and other appropriate terminology may be used interchangeably as appropriate without departing from the scope of this disclosure. Moreover, this disclosure contemplates that many users may use one computer 702, or that one user may use multiple computers 702.

Figure 8:
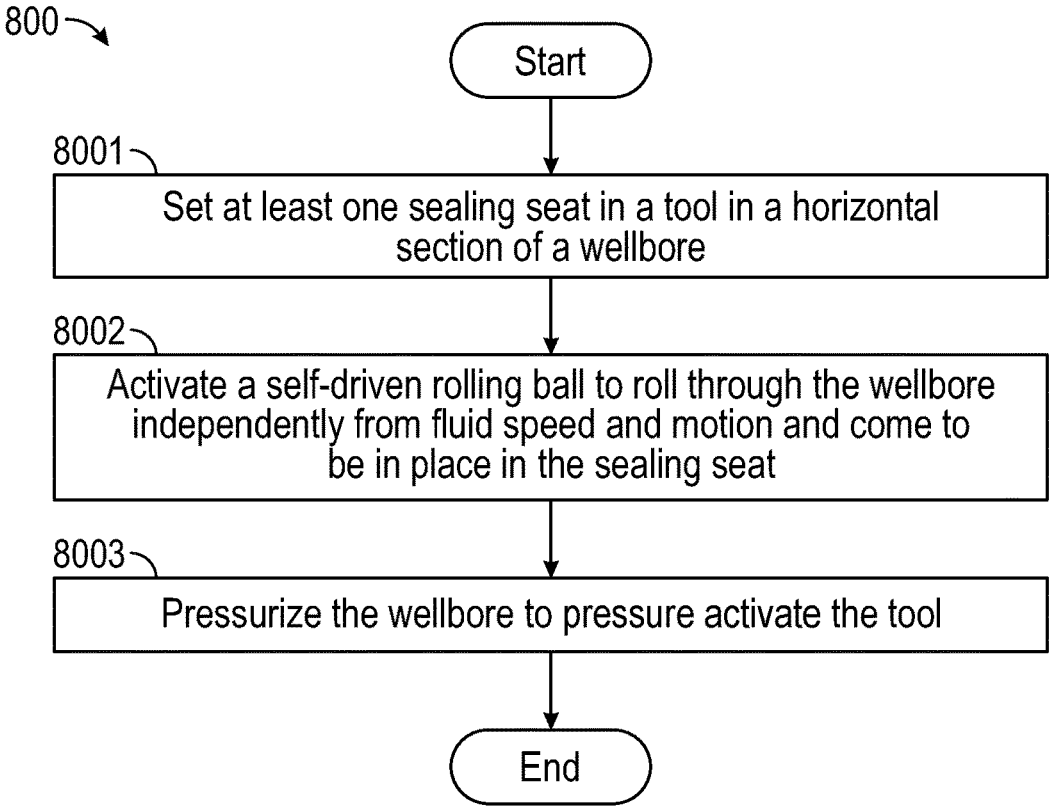
FIG. 8 is a flowchart of a method for pressure activation of a tool in a wellbore in accordance with one or more embodiments.

FIG. 8 is a flowchart of a method 800 for pressure activation of a tool in a wellbore in accordance with one or more embodiments. While the various blocks in FIG. 8 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In step 8001, at least one sealing seat is set in the tool in a horizontal section of a wellbore. The tool may be, for example, used in wellbore completion, intervention, production, and others, and may comprise a string which is set in a horizontal section of a wellbore. Any number of the sealing seats, for example, one, two, or more, may be set in the tool as necessary. The sealing seats may be provided with any of the features described above. For example, the sealing seat may comprise a through hole which allows fluid flowing through the sealing seat.

In step 8002, upon activation, a self-driven sealing ball rolls through the wellbore independently from fluid speed and motion and come to be in place in the sealing seat. The sealing ball may be with any of the features as described above. The sealing ball has a size which matches the end notch of the through hole in the sealing seat. As such, the string can be sealed when the sealing ball comes to be in place in one of the end notches of the though hole of the sealing seat.

As one example, the through hole of the sealing seat may include two end notches on both sides of the sealing seat along the horizontal section of the tool. The sealing ball is activated to roll through the wellbore and selectively come to be in place in the sealing seat on the first side or the second side.

As another example, a first sealing seat and a second sealing seat are separately set in different locations in the tool along the horizontal section of the wellbore. The sealing ball may be activated to roll through the wellbore and selectively come to be in place in the first sealing seat or the second sealing seat.

In step 8003, the wellbore is pressurized to pressure activate the tool. In one or more embodiments, when a sealing ball comes to be in place in the notch of the through hole on one of the two sides along the string, a pressure from the fluid in the string will keep the ball on the notch and prevent the fluid from flowing through the through hole of the sealing seat. As such, the zone from the side of the sealing seat in the string is deactivated. If necessary, the ball may be activated to roll out of place from the seat to release the pressurization thereby reactivating the zone.

While the disclosure has been described with respect to a limited number of embodiments, those skilled in the art, having benefit of this disclosure will appreciate that other embodiments can be devised which do not depart from the scope of the disclosure. Accordingly, the scope of the disclosure should be limited only by the attached claims.

What is claimed is:

1. A system for pressure activation of a tool in a wellbore, the system comprising:

a sealing seat for being set in the tool in a horizontal section of the wellbore; and a timer coupled to a self-driven sealing ball;

wherein the timer is configured for sending a signal to a controller to activate the self-driven sealing ball to self-roll, wherein the timer starts a counting when the self-driven sealing ball is dropped into the wellbore, wherein the timer sends the signal when the counting reaches a predefined time period, wherein the controller ends the counting upon detection of a pressure spike, wherein the self-driven sealing ball, upon being activated, is configured for rolling through the wellbore independently from fluid speed and motion so as to engage the sealing seat thereby forming a sealing of the horizontal section of the wellbore against fluid flow therethrough, wherein, due to the sealing of the wellbore, upon pressurization the pressure spike is formed, and the pressure spike performs the pressure activation of the tool for a completion operation.

2. The system of claim 1, wherein the sealing seat has a first side and a second side along the horizontal section of the tool; and wherein the sealing ball is activated to roll through the wellbore and selectively comes to be in place in the sealing seat on the first side or the second side of the sealing seat.

3. The system of claim 1, wherein the system comprises a first sealing seat and a second sealing seat separately set in different locations in the tool along the horizontal section of the wellbore; and wherein a first sealing ball is activated to roll through the wellbore and selectively come to be in place in the first sealing seat or the second sealing seat.

4. The system of claim 1, wherein the sealing ball comprises:

a shell defining an outer surface for fitting with the sealing seat and an inner chamber sealing from fluid in the wellbore; and an actuator in the chamber for driving the shell to roll through the wellbore independently from fluid speed and motion and come to be in place in the sealing seat.

5. The system of claim 4, wherein the actuator comprises:

a battery-powered motor;

a wheel in the chamber for being driven by the motor to generate rolling of the shell; and a controller for controlling the motor to generate rolling of the shell independently from fluid speed and motion within the wellbore.

6. The system of claim 5, wherein the actuator further comprises:

at least one detector in the shell selected from: a G-sensor, an acceleration sensor, a pressure transducer, or an inclination angle detector.

7. The system of claim 4, wherein the shell is made of: a plastic material, a metal, or a combination thereof.

8. The system of claim 4, wherein the shell comprises a traction mechanism on the outer surface.

9. The system of claim 4, wherein the sealing ball further comprises:

a weight for balancing the rolling of the shell along the wellbore.

10. The system of claim 1, further comprising:

a pressure transducer, configured to detect the pressure spike, coupled to the timer and to the controller;

wherein the pressure transducer is configured for sending a signal to the controller to end the counting upon detecting the pressure spike.

11. A completion tool, comprising:

a string set for being in a horizontal section of a wellbore;

a sealing seat for being set in the string; and a timer for sending a signal to a controller to activate a self-driven sealing ball to self-roll, wherein the timer starts a counting when the self-driven sealing ball is dropped into the wellbore, wherein the timer sends the signal when the counting reaches a predefined time period, wherein the controller ends the counting upon detection of a pressure spike, wherein the self-driven sealing ball, upon activation, is configured for rolling through the string in the horizontal section of the wellbore independently from fluid speed and motion and coming to be in place in the sealing seat thereby forming a sealing of the horizontal section of the wellbore against fluid flow therethrough, wherein, due to the sealing of the wellbore, upon pressurization, the pressure spike is formed, and the pressure spike performs the pressure activation of the tool for a completion operation.

12. The completion tool of claim 11, wherein the sealing seat has a first side and a second side along the horizontal section of the tool; and wherein, upon activation, the sealing ball rolls through the wellbore and selectively come to be in place in the sealing seat on the first side or the second side.

13. The completion tool of claim 11, wherein the completion tool comprises a first sealing seat and a second sealing seat separately set in different locations in the string along the horizontal section of the wellbore; and wherein, upon activation, the sealing ball rolls through the wellbore and selectively come to be in place in the first sealing seat or the second sealing seat.

14. The completion tool of claim 11, wherein the sealing ball comprises:

a shell defining an outer surface for fitting with the sealing seat and an inner chamber sealing from fluid in the wellbore; and an actuator in the chamber for driving the shell to roll through the wellbore independently from fluid speed and motion and come to be in place in the sealing seat.

15. The completion tool of claim 14, wherein the actuator comprises:

a battery-powered motor;

a wheel in the chamber for being driven by the motor to generate rolling of the shell; and a controller for controlling the motor to generate rolling of the shell independently from fluid speed and motion.

16. The completion tool of claim 15, wherein the actuator further comprises:

at least one detector in the shell selected from: a G-sensor, an acceleration sensor, or an inclination angle detector.

17. The completion tool of claim 11, further comprising:

a pressure transducer, configured to detect the pressure spike, coupled to the timer and to the controller;

wherein the pressure transducer is configured for sending a signal to the controller to end the counting upon detecting the pressure spike.

18. A method for pressure activation of a tool in a wellbore, the method comprising:

setting a sealing seat in the tool in a horizontal section of the wellbore;

coupling a timer to a self-driven sealing ball;

wherein the timer is configured for sending a signal to a controller to activate the self-driven sealing ball to self-roll, wherein the timer starts a counting when the self-driven sealing ball is dropped into the wellbore, and wherein the timer sends the signal when the counting reaches a predefined time period, wherein the controller ends the counting upon detection of a pressure spike, activating the self-driven sealing ball to roll through the wellbore independently from fluid speed and motion and come to be in place in the sealing seat thereby forming a sealing of the horizontal section of the wellbore against fluid flow therethrough;

pressurizing the wellbore to form the pressure spike; and pressure activating the tool for a completion operation using the pressure spike.

19. The method of claim 18, wherein the sealing seat has a first side and a second side along the horizontal section of the tool; and wherein, upon activation, the sealing ball to roll through the wellbore and selectively come to be in place in the sealing seat on the first side or the second side.

20. The method of claim 18, wherein a first sealing seat and a second sealing seat are separately set in different locations in the tool along the horizontal section of the wellbore; and wherein the sealing ball is activated to roll through the wellbore and selectively come to be in place in the first sealing seat or the second sealing seat.

* * * * *